United States Patent [19]

Marble et al.

[11] Patent Number: 4,954,091

[45] Date of Patent: Sep. 4, 1990

[54] CONVERTIBLE GROUND SAFETY PLUG

[76] Inventors: Steven C. Marble, 330 S. Washington; Gary D. Marble, 304 W. Grand, both of Neosho, Mo. 64850

[21] Appl. No.: 450,540

[22] Filed: Dec. 14, 1989

[51] Int. Cl.[5] ..... H01R 4/66

[52] U.S. Cl. ..... 439/103; 439/104

[58] Field of Search ..... 439/102–106, 439/166, 171, 172, 174

[56] References Cited

U.S. PATENT DOCUMENTS 2,986,718 5/1961 Bender ..... 439/109

3,685,000 8/1972 Robbins ..... 439/103

FOREIGN PATENT DOCUMENTS 502398 4/1951 Belgium ..... 439/103

*Primary Examiner*—Eugene F. Desmond

*Attorney, Agent, or Firm*—Michael I. Kroll

[57] ABSTRACT

A convertible ground safety plug is provided and consists of a grounding prong carried in an insulated housing. The ground prong can be moved between an active position projecting outwardly from the housing and an inactive position not projecting outwardly from the housing, so that the plug can be utilized for a three slot receptacle and a two slot receptacle.

1 Claim, 2 Drawing Sheets

Fig. 1
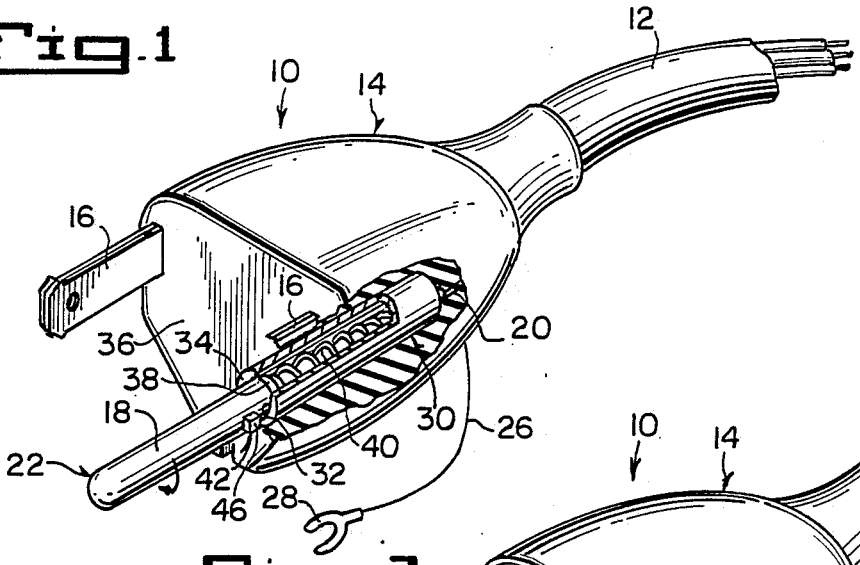
Fig. 2
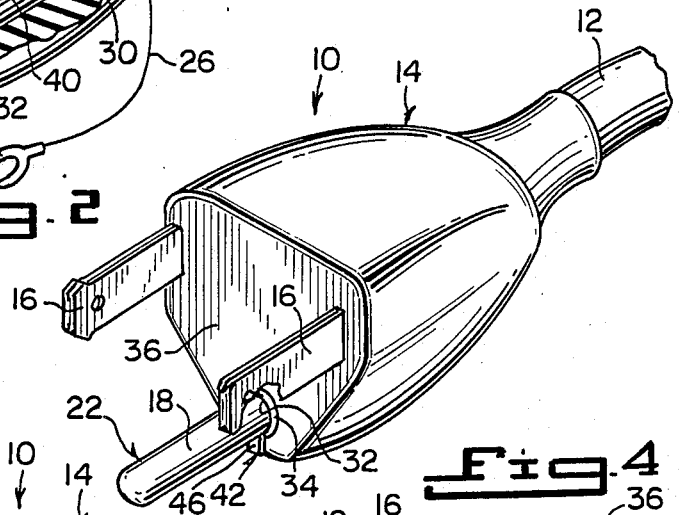
Fig. 3
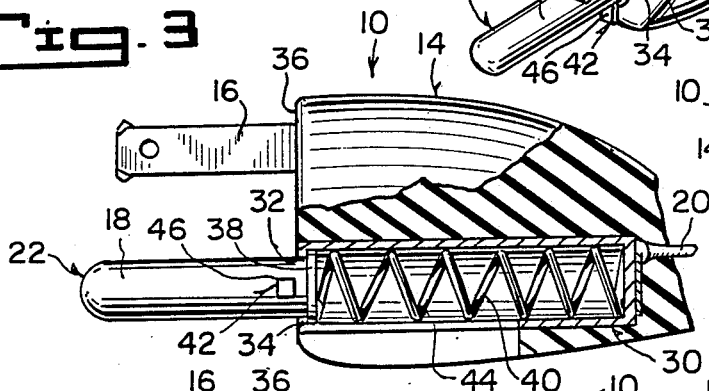
Fig. 4
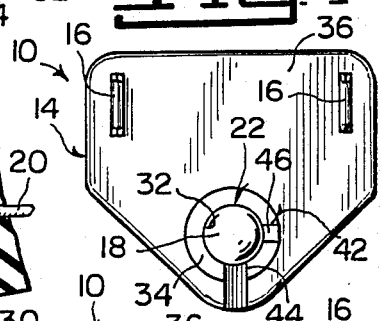
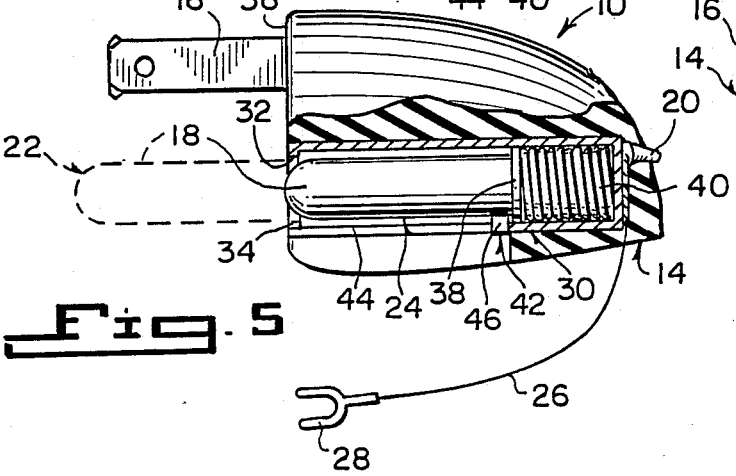
Fig. 5
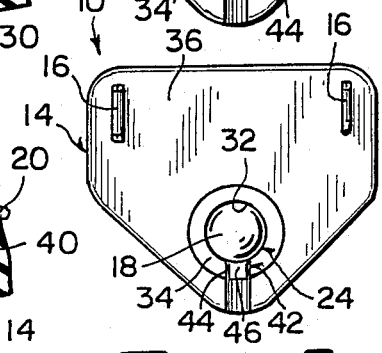
Fig. 6

Fig. 7
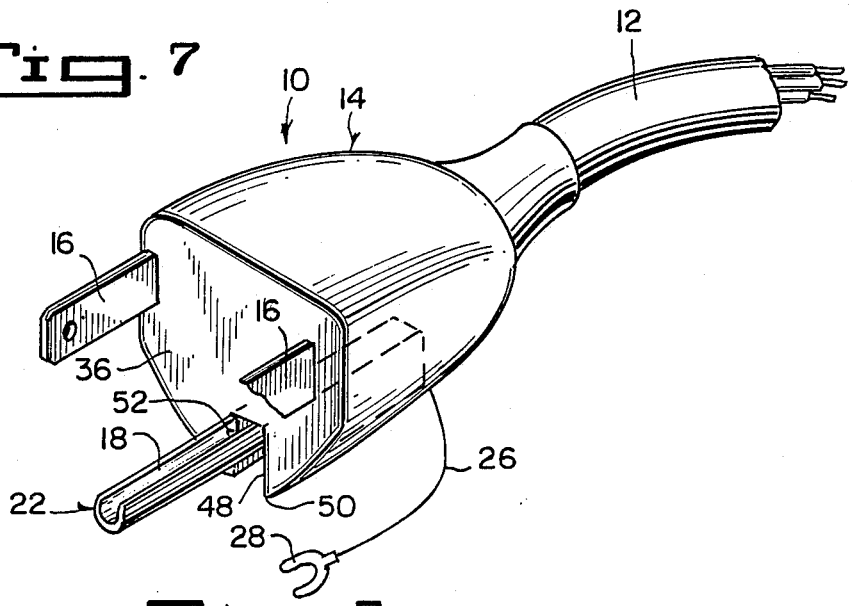
Fig. 8
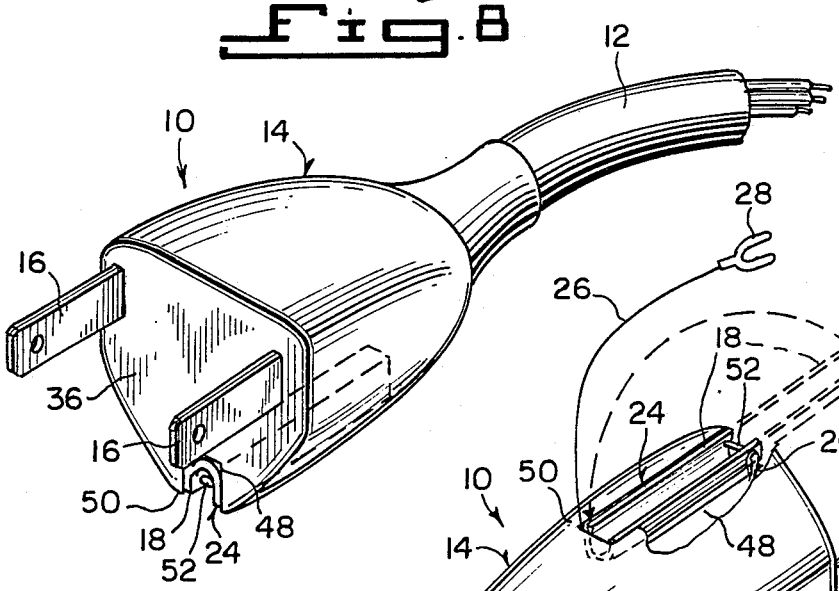
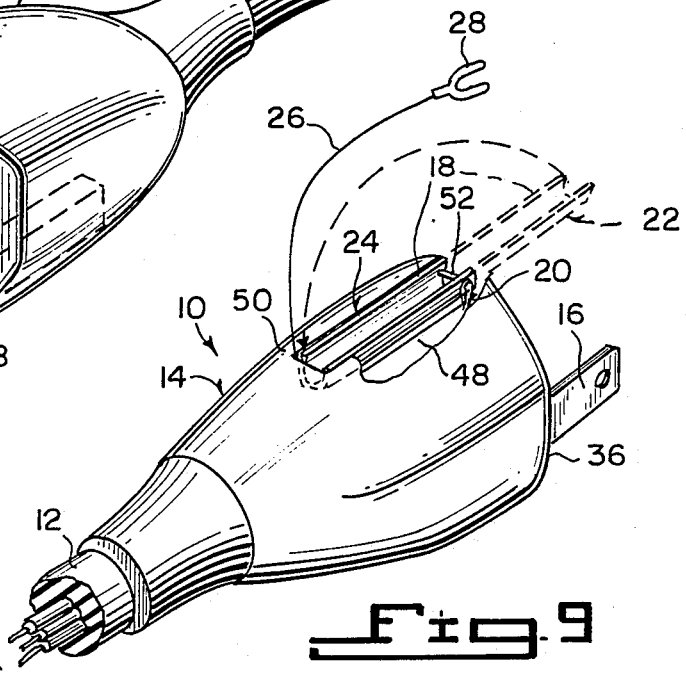
Fig. 9
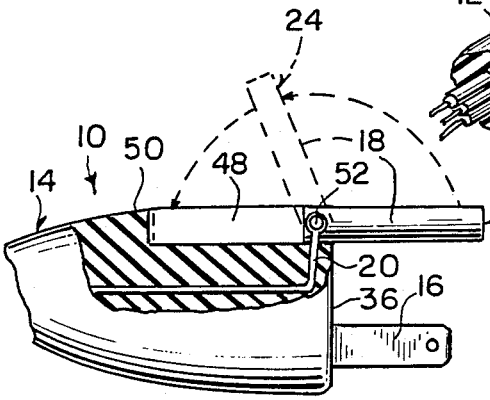
Fig. 10

CONVERTIBLE GROUND SAFETY PLUG

BACKGROUND OF THE INVENTION

1. Field of the Invention

The instant invention relates generally to three prong electrical plugs and more specifically it relates to a convertible ground safety plug.

2. Description of the Prior Art

Numerous three prong electrical plugs have been provided in the prior art that are adapted to plug into both two and three wire wall receptacles. For example, U.S. Pat. Nos. 2,323,736 to Tousley; 2,989,719 to Aarlaht; 3,308,415 to Cramer et al; 3,786,392 to McDaniel and 4,078,848 to Blairsdale all are illustrative of such prior art. While these units may be suitable for the particular purpose to which they address, they would not be as suitable for the purposes of the present invention as heretofore described.

SUMMARY OF THE INVENTION

A primary object of the present invention is to provide a convertible ground safety plug that will overcome the shortcomings of the prior art devices.

Another object is to provide a convertible ground safety plug in which the grounding prong is retractable so that the plug can be utilized for a three slot receptacle and a two slot receptacle.

An additional object is to provide a convertible ground safety plug which eliminates the troublesome use of a separate adapter plug thus doing away with the chance of a person receiving a shock due to a bad connection.

A further object is to provide a convertible ground safety plug that is simple and easy to use.

A still further object is to provide a convertible ground safety plug that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a front perspective view of the invention with parts broken away showing the grounding prong in an extended locked active position.

FIG. 2 is a front perspective view of the invention with parts broken away showing the grounding prong in an extended unlocked position.

FIG. 3 is a side view with parts broken away of the invention as in FIG. 1.

FIG. 4 is a front view of FIG. 3.

FIG. 5 is a side view with parts broken away of the invention showing the grounding prong in a retracted inactive position.

FIG. 6 is a front view of FIG. 5.

FIG. 7 is a front perspective view of a modification of the invention with parts broken away showing the grounding prong in an extended active position.

FIG. 8 is a front perspective view similar to FIG. 7 showing the grounding prong in a retracted inactive position.

FIG. 9 is an inverted rear perspective view of FIG. 8 with parts broken away.

FIG. 10 is an inverted side view of FIG. 7 with parts broken away.

DETAILED DESCRIPTION OF THE PREFERRED EMBODIMENTS

Turning now descriptively to the drawings, in which similar reference characters denote similar elements throughout the several views, the Figures illustrate a convertible ground safety plug 10 in combination with a three conductor power cord 12 consisting of an insulated housing 14 with a pair of power prongs 16 securely embedded in the housing 14 electrically connected to two of the conductors (not shown) and projecting outwardly from the housing 14. A grounding prong 18 is carried in the housing 14 and is electrically connected to the third conductor 20. The grounding prong 18 can be moved between an active position 22 projecting outwardly from the housing 14 and an inactive position 24 not projecting outwardly from the housing 14. The plug 10 can be utilized for a three slot receptacle (not shown) and a two slot receptacle (not shown) to complete an electrical circuit.

A wire 26 is provided with a C-shaped connector 28 on one end and is electrically connected at the other end to the third conductor 20 so that the connector 28 can be attached to a ground screw (not shown) when the plug 10 is utilized for the two slot receptacle to ground the plug 10.

A conductive general cylindrical sleeve 30 having an open end 32 with an internal retaining lip 34 is shown in FIGS. 1 through 6. The sleeve 30 is embedded in the housing 14 so that the retaining lip 34 is in alignment with the end 36 of the housing 14 having the power prongs 16 projecting outwardly therefrom and is electrically connected to the third conductor 20. The grounding prong 18 has an enlarged ring 38 on an inner end adapted to slide within the sleeve 30 so that when the ring 38 contacts the retaining lip 34 it will prevent the grounding prong 18 from disengaging from the sleeve 30.

A spring 40 is mechanically and electrically secured between the interior of the sleeve 30 and the ring 38 on the grounding prong 18 to provide electrical contact between the third conductor 20 and the grounding prong 18. The spring 40 is of sufficient resilience to independently automatically maintain the grounding prong 18 in its outwardly projecting active position when the plug 10 is inserted into the three slot receptacle and automatically allows the grounding prong 18 to retract to its inactive position within the sleeve 30 when the plug 10 is inserted into the two slot receptacle.

The plug 10 further includes a structure 42 for locking the grounding prong 18 in its outwardly projecting active position before the plug 10 is inserted into the three slot receptacle. The locking structure 42 includes the sleeve 30 having a longitudinal slot 44 therein. A locking tab 46 extends from the side of the grounding prong 18 adjacent the enlarged ring 38 on the inner end thereof. The grounding prong 18 can be turned to place the locking tab 46 in alignment with the slot 44 to allow the grounding prong 18 to go into its retracted inactive position and to place the locking tab 46 out of alignment with the slot 44 to lock the grounding prong 18 in its outwardly projecting active position.

FIGS. 7 through 10 shows the housing 14 having a recess 48 from on the side 50 opposite from said power prongs 16. A pivot pin 52 on an inner end of the grounding prong 18 is within the recess 48 near the end 36 of the housing 14 having the power prongs 16 projecting outwardly therefrom. The pivot pin 52 is electrically connected to the third conductor 20 so that the grounding pin 18 can be flipped outwardly to its active projecting position 22 and can be flipped inwardly to its inactive retracted position 24.

Furthermore the aforsaid invention is intended to cover the use of a similar plug differing only in the use of a polorized prong.

LIST OF REFERENCE NUMBERS 10 convertible ground safety plug
12 three conductor power cord
14 insulated housing
16 power prong
18 grounding prong
20 third conductor in 12
22 active position of 16
24 inactive position of 16
26 wire
28 C-shaped connector on 26
30 conductive cylindrical sleeve
32 open end in 30
34 internal retaining lip in 32
36 end of 14
38 enlarged ring on 18
40 spring
42 locking structure
44 longitudinal slot 44 in 30
46 locking tab
48 recess in 14
50 side of 14
52 pivot pin It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A convertible ground safety plug in combination with a three conductor power cord, comprising:

(a) an insulated housing;

(b) a pair of power prongs securely embedded in said housing electrically connected to two of the conductors and projecting outwardly from said housing;

(c) a grounding prong carried in said housing electrically connected to the third conductor;

(d) means for moving said grounding prong between an active position projecting outwardly from said housing and an inactive position not projecting outwardly from said housing so that said plug can be utilized for a three slot receptacle and a two slot receptacle to complete an electrical circuit, said moving means including a conductive general cylindrical sleeve having an open end with an internal retaining lip therein, said sleeve embedded in said housing so that said retaining lip is in alignment with the end of said housing having said power prongs projecting outwardly therefrom and electrically connected to the third conductor, said grounding prong having an enlarged ring on an inner end adapted to slide within said sleeve so that when said ring contacts said retaining lip it will prevent said grounding prong from disengaging from said sleeve, and a spring mechanically and electrically secured between the interior of said sleeve and said ring on said grounding prong to provide electrical contact between the third conductor and said grounding prong, said spring being of sufficient resilience to independently, automatically maintain said grounding prong in its outwardly projecting active position when said plug is inserted into the three slot receptacle and automatically allowing said grounding prong to retract to its inactive position within said sleeve when said plug is inserted into the two slot receptacle;

(e) a wire with a "C"-shaped connector on one end and electrically connected at the other end to the third conductor so that said connector can be attached to a ground screw when said plug is utilized for the two slot receptacle to ground said plug; and (f) means for locking said grounding prong in its outwardly projecting active position before said plug is inserted into the three slot receptacle, said locking means including said sleeve having a longitudinal slot therein, and a locking tab extending from the side of said grounding prong adjacent said enlarged ring on the inner end thereof so that said grounding prong can be turned to place said locking tab in alignment with said slot to allow said grounding prong to go into its retracted inactive position and to place said locking tab out of alignment with said slot to lock said grounding prong in its outwardly projecting active position.

* * * * *